United States Patent [19]

Johnson

[11] 4,080,548

[45] Mar. 21, 1978

[54] LIGHTING SYSTEM HAVING DIMMING CAPABILITIES

[75] Inventor: Robert W. Johnson, Ridgewood, N.J.

[73] Assignee: Precision Controls, Inc., Hawthorne, N.J.

[21] Appl. No.: 755,027

[22] Filed: Dec. 28, 1976

Related U.S. Application Data

[63] Continuation-in-part of Ser. No. 650,008, Jan. 19, 1976, abandoned.

[51] Int. Cl.[2] ..... H01J 7/44; H01J 13/46; H01J 17/34; H01J 19/78

[52] U.S. Cl. ..... 315/68; 315/64; 315/67; 315/320; 313/316

[58] Field of Search ..... 315/64, 65, 66, 67, 315/68, 69, 320, 360; 313/316

[56] References Cited

U.S. PATENT DOCUMENTS

| | | | |
|---|---|---|---|
| 1,513,407 | 10/1924 | Lombos | 315/68 |
| 1,819,690 | 8/1931 | Ricker | 315/68 |
| 2,217,794 | 10/1940 | Davis, Jr. | 315/68 X |
| 2,874,331 | 2/1959 | Otto | 315/68 X |
| 3,408,523 | 10/1968 | Demarest et al. | 315/64 X |
| 3,416,020 | 12/1968 | Carley | 315/68 X |
| 3,508,114 | 4/1970 | Johansson et al. | 315/320 X |
| 3,579,030 | 5/1971 | Bentham et al. | 315/320 |

*Primary Examiner*—Saxfield Chatmon, Jr.
*Attorney, Agent, or Firm*—Fitzpatrick, Cella, Harper & Scinto

[57] ABSTRACT

A lighting system provided with a plurality of filaments, the wattage ratings of which differ in a predetermined relationship. The filaments are selectively energized so that the light intensity of the lamp may be varied in steps, without a change in color temperature which otherwise results when the intensity is varied in response to a varying voltage applied to a single filament.

12 Claims, 5 Drawing Figures

LIGHTING SYSTEM HAVING DIMMING CAPABILITIES

This is a continuation-in-part of Applicant's earlier filed application Ser. No. 650,008, now abandoned, filed on Jan. 19, 1976.

BACKGROUND OF THE INVENTION

1. Field of the Invention

This invention relates generally to lighting systems, having dimming capabilities, wherein light is derived from individual lamps, or groups of lamps, adapted to operate over a wide range of selected levels of brightness.

2. Description of the Prior Art

It is often desirable to vary the level of illumination emitted from incandescent lamps used in theaters and television studios. One simple solution is to employ a rheostat in series with a number of mono-filament lamps, but a disadvantage of this method is the excessive waste of power by the rheostat at low light level settings. Variable autotransformers, while more efficient, still occupy considerable space and, like rheostats, require mechanical coupling means. Another system involves the use of a reactance dimmer, wherein the A.C. line which energizes the lamps is serially connected to a magnetic core winding. A D.C. control current is allowed to flow through another winding on the same core, thus varying the reactance presented to the A.C. lamp current.

The development of thyristor devices gave rise to another popular method of incandescent lamp brightness control. Two SCR's connected "back to back" (or one Triac) are coupled in series with the lamps to permit load current to flow over a selected portion of both halves of the A.C. cycle when the appropriate gate terminals are energized. The net result is that the average voltage applied to the lamps is varied in a more efficient and space-saving manner, and the power dissipated in the SCR's is minimal, even at low light-level settings.

All of the above-mentioned systems, however, operate to change light intensity by varying the average voltage applied to the lamp filaments. This inherently produces changes in color characteristics of the light in that the color temperature of the lamp changes; that is, the peak frequency of light from the lamp varies with variations in temperature of the lamp filament, and such temperature variations result from changing the supply voltage to the filament. These color temperature changes are objectionable in many applications, especially when illuminating subjects for color television broadcasting. Standard multifilament lamps, commonly used in the home, maintain a substantially constant color temperature when either or both filament sections are energized at full operating voltage. However, gradual brightness control over a wide light-level range is not obtainable because the filament wattage combinations are in low ranges, such as 30, 70, 100 or 25, 50, 75.

Furthermore, even though an SCR-type control circuit is more efficient than earlier rheostat dimmers, its efficiency is somewhat reduced due to its requirement for a large and expensive choke. The choke is necessary for slowing down the rise time of the load current from a few micro-seconds to approximately 500 micro-seconds in order to reduce radio-frequency-interference signals to an acceptable level, and in order to prevent an audible noise from being generated by the lamp filaments due to the steep current rise time. Also, because the SCR controlled devices must be connected in series with the lamps according to the conventional systems, it is necessary to run heavy power wire throughout the entire system. That is, it is necessary to run power wire from the power source to the dimmer bank and then to the lamps, and since the dimmer bank may be located at a substantial distance from the lighted area, extensive lengths of power wire are required.

Alternatively, if the SCR dimmer circuit is mounted on the lamp fixture, the additional power wire is not required, but the choke itself produces a sound which is highly objectionable. On the other hand, if the electronic switching devices are controlled to switch near the zero current level, whereby dimming is effected by completely eliminating selected half-cycles of the supplied power, the choke can be omitted, but a noticeable flickering occurs.

SUMMARY OF THE INVENTION

According to the present invention, the above and other shortcomings in the prior art may be overcome by providing an incandescent lamp having multiple filaments, the wattage ratings of which, and possible combinations thereof, allow for a relatively small incremental variation in brightness over the full operating range. Particular combinations of filaments are selected either by mechanical means, such as a specially configured switch, or by electrical means such as associated thyristor devices with appropriate driving circuitry.

The result of this configuration is that each selected filament is energized at full line potential, so that little or no variation in color temperature will be experienced at different stages of brightness. That is, the lamp and dimming system disclosed herein, which provides a variable light intensity over a wide range, produces a novel result wherein the varying light does not give the appearance of causing a color change in objects which it illuminates. Furthermore, when using electrical means for brightness control according to the present invention, such means may be mounted on or near the lamp support, so that a remote control device may be coupled to the lamp control circuit with signal wire rather than power wiring as in conventional brightness control dimming systems.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other systems for carrying out the purposes of this invention. It is important, therefore, that this disclosure be regarded as including such equivalent constructions as do not depart from the spirit and scope of the invention.

BRIEF DESCRIPTION OF THE DRAWINGS

Specific embodiments of the invention are disclosed herein for purposes of illustration and description, and are shown in the accompanying drawings forming a part of this specification, wherein:

FIG. 3 illustrates a modification of the arrangement of FIG. 2;

DESCRIPTION OF THE PREFERRED EMBODIMENTS

Figure 1:
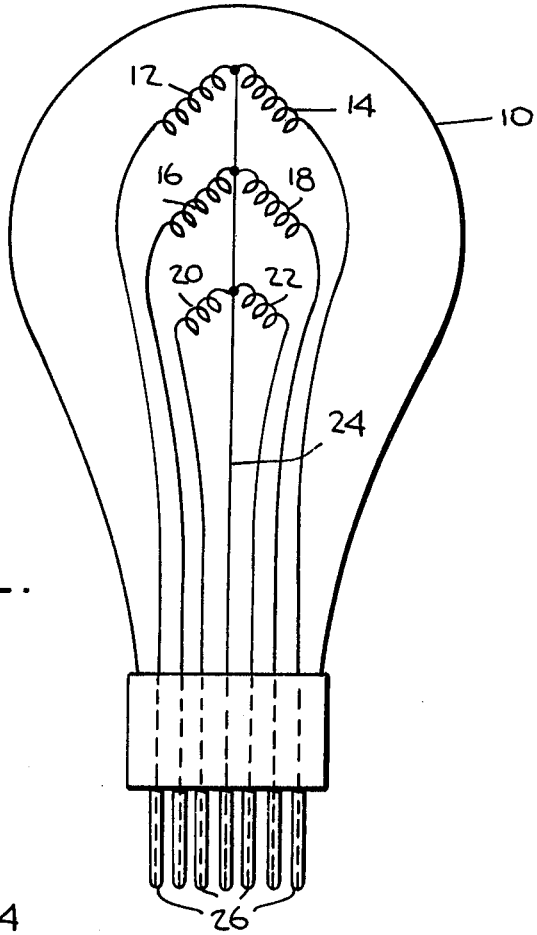
FIG. 1 illustrates an incandescent lamp according to the present invention.

An incandescent lamp 10, according to the present invention, is shown in FIG. 1 as having a plurality of filament sections 12–22. Each section is electrically connected to a common conducting electrode 24 which, in turn, connects with one of a group of base pins 26. It is understood that the exact numberof filament sections employed may be varied according to design requirements, but a concept which underlies the present invention is that the filaments should have a particular light output or intensity rating in relation to each other. This relationship is such that each successive higher rated filament has twice the light output of the preceding filament. For example, in FIG. 1, filament section 12 may be rated at 25 watts, section 14 at 50 watts, section 16 at 100 watts, and so forth so that section 22 has a rated value of 800 watts. It is to be understood that since an object of the invention is to provide a variation in light output for a lamp, the filaments of the preferred embodiment provide a light output which doubles for successive filaments, even though the actual wattages of such filaments may vary somewhat from doubled values. It is apparent that by using only six filament sections as described above, a total of 1575 watts may be provided and, by appropriate filament selection means, the lighting power may be reduced by 25 watt increments in 63 steps down to a zero value. In all embodiments of the invention utilizing the lamp illustrated in FIG. 1, each lamp has at least four filaments providing 15 separate lighting increments. Alternatively, another embodiment of the system may include a group of at least four lamps, each having a single different light output rating chosen to provide at least 15 separate lighting increments as discussed above. This latter embodiment, as described below, may conveniently utilize quartz lamps, such as available from General Electric Co. and sold under the trademark QUARTZLINE.

In a preferred embodiment of the lamp 10, the 800 watt filament section 22 may comprise four individual 200 watt filaments connected in parallel, since the heating and cooling time of such parallel connected configuration compares more closely to the heating and cooling times of the remaining filaments of the lamp. Accordingly, the term "filament" is intended to encompass a single filament unit or a plurality of individual filament units connected in parallel.

Figure 2:
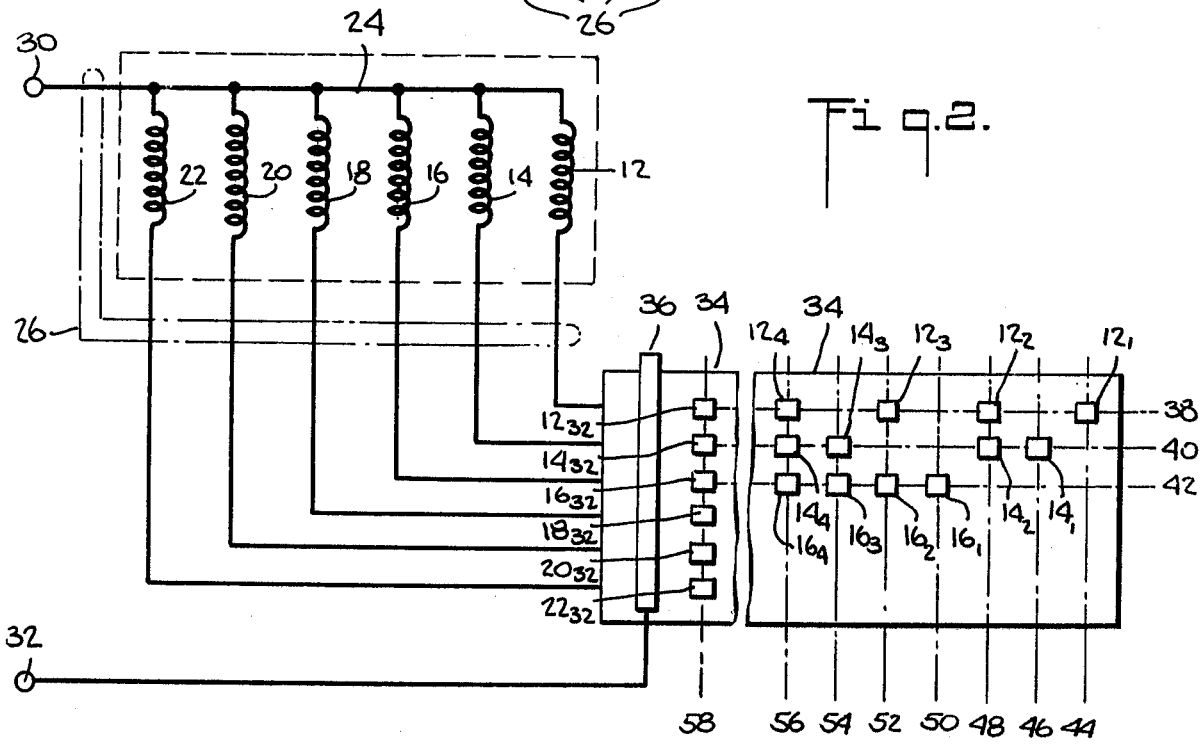
FIG. 2 is a schematic diagram of the lamp of FIG. 1 showing one arrangement for the energization of filaments therein.

FIG. 2 is illustrative of the lamp 10 connected in a circuit to the supply voltage terminals 30 and 32 of a power source having, for example, a line voltage of 110V or 220V. As shown, one side of the supply voltage, terminal 30, is connected to electrode 24, while the other side thereof, terminal 32, is connected to a binary switching device 34. The device 34 includes a movable conducting wiper blade 36 which is maintained in electrical contact with power terminal 32. Such contact may be maintained by a braided wire or by other means well known in the art. A series of electrically conducting pads $12_1 - 12_{32}$ are placed along reference line 38 in a predetermined spaced-apart relation on the switch 34. Each of these pads are connected with the filament 12 through one of the lamp pins 26. It will be appreciated that when the blade 36 overlies these pads, namely at positions 44, 48, 52, 56 and at unshown intermediate locations to position 58, voltage is applied across the filament 12. A second series of pads $14_1 - 14_{32}$ are placed on the switch 34 along reference line 40. Their spacing is arranged so that the wiper 36 is in physical contact therewith at positions 46, 48, 54, 56 and at unreferenced locatins to position 58. This series of pads electrically connects with filament 14 through one of the pins 26, thereby permitting that filament to be energized when the wiper 36 is placed at the above-mentioned locations. A third series of pads $16_1 - 16_{32}$ are selectively placed along reference line 42 and connect with filament 16. The remaining filaments 18, 20 and 22 are likewise connected respectively through 32-pad series of contact pads on switch 34, wherein only the last set of these pads are shown in FIG. 2 at switch position 58.

In the operation of the circuit shown in FIG. 2, the contact pads associated with the six lamp filaments define a consecutive binary number pattern on the switch 34. The pads associated with the 25 watt filament 12 correspond to the least significant bit, while those pads connected to the 800 watt filament 22 correspond to the sixth and most significant bit. Thus, because of the chosen filament wattages, and the connection of the filaments with the binary patterned contact pads on switch 34, incremental lamp brightness control is made possible in 25 watt steps.

Conveniently, the lamp illustrated in FIG. 2, may be mounted on a portable unit, along with the switching device 34, thereby providing an individual lamp, having dimming capabilities, which may be plugged into a supply voltage outlet by means of terminals 30 and 32.

The mechanical power switch 34 of FIG. 2 may be replaced by a signal switch **34*a* and a plurality of Triacs 64–74 as shown in FIG. 3. The binary switching device 34*a* is similar in design and function to that described in FIG. 2**, with the advantage that only gating current for the Triacs flows through the contacts.

In operation, a brightness level is selected by moving the binary switching device. Gating current will flow from a power supply (P.S.) through the selected switch contacts of switch **34*a*, and through respective resistors 59, to "gate-on" the selected Triacs, thereby allowing current to flow through selected filaments. The advantage of this embodiment over that of FIG. 2** is that the life of the switch is increased many times due to the lower currents flowing therethrough.

Figure 4:
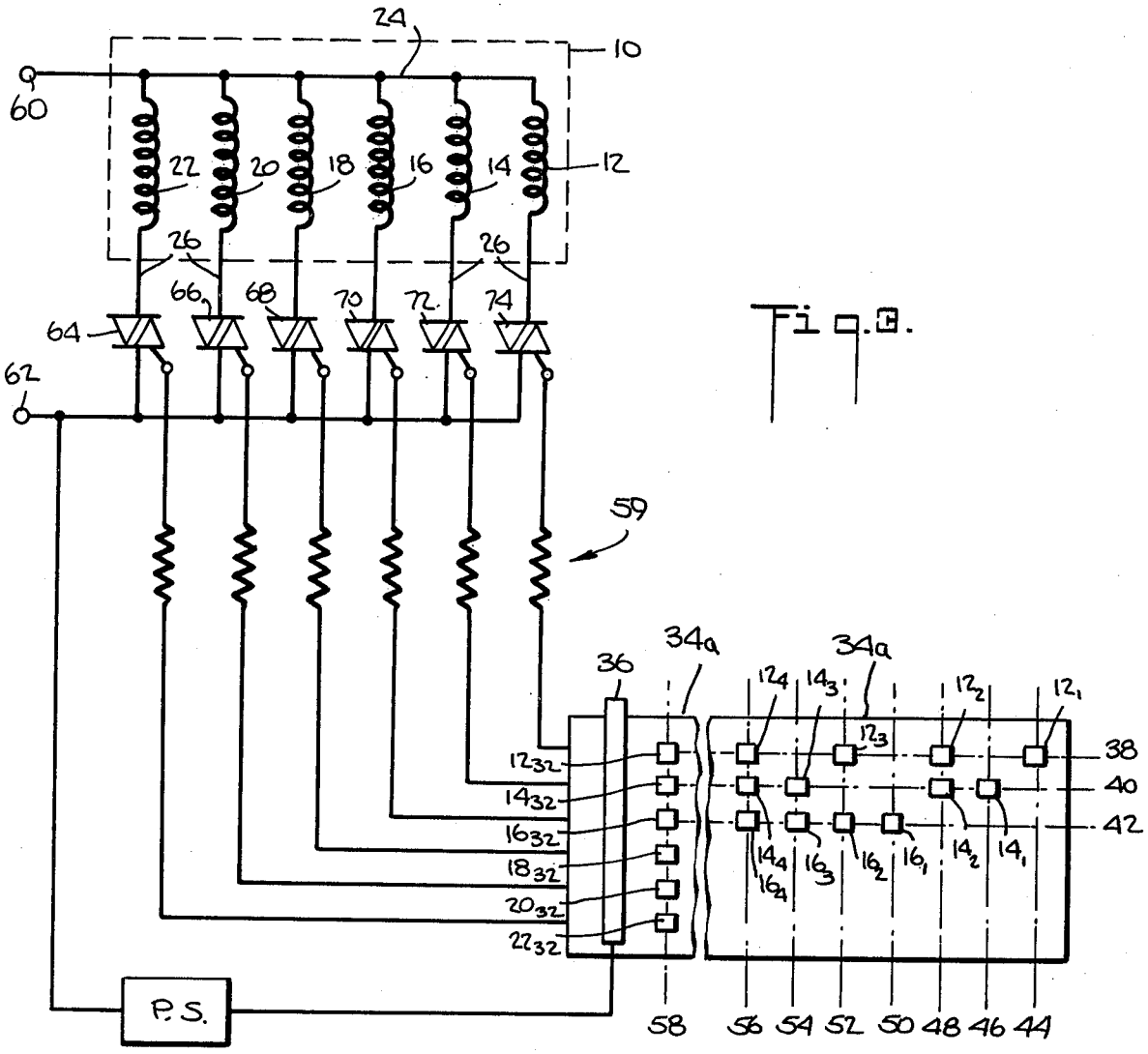
FIG. 4 is a schematic diagram of the lamp of FIG. 1 with a third arrangement for the energization of its filaments.

The mechanical switching scheme of FIG. 2 may be replaced by an electrical driving system as shown in FIG. 4. In this embodiment, the six filaments 12–22 of the lamp 10 are connected at one of their ends to a power input terminal 60 by way of electrode 24. The other ends of the filaments each connect with one main terminal of associated Triacs 64–74 through their respective base pins 26. The opposed main terminals of the Triacs each connect together and to a power source terminal 62. It is understood in the art, of course, that two SCR's in a parallel configuration may be substituted for each Triac. A series of six pulse transformers 76 are each arranged to trigger an associated Triac into a conductive state upon the occurrence of pulses from pulsing circuits 78. An important characteristic of this second embodiment is that the selected Triacs are fired at the beginning of each half cycle of the A.C. power source potential. Such operation allows the load current to continually flow in a sinusoidal fashion through the associated filament. On the other hand, a conventional SCR dimming system operates to permit lamp current to begin to flow at various selected portions of the A.C. cycle. As a result, radio frequency interference is generated due to fast rising load currents. Chokes may be inserted serially in the power line to reduce this interference, but will typically cause a drop of about six volts in voltages applied to the lamp from the source. Since switching occurs near the zero level of the A.C. supply voltage in the present embodiment, however, the need for such chokes is obviated due to the absence of sudden current rises. A line voltage drop of about one volt across each selected filament circuit is all that is attributable to each Triac.

Particular filaments are selected in the embodiment of FIG. 4 by means of a variable D.C. control signal (0 – 10 volts for example) applied at terminals 80, 82 to an analog to digital convertor 84. The operation of the convertor 80, as is well known in the art, is analogous to that of the sliding switch 34 in FIG. 2. As the D.C. input voltage is increased, the six pulsing circuits 78 are activated in a binary pattern with the uppermost circuit 78*a*, coupled to filament 12, corresponding to the least significant bit.

In a preferred installation of the configuration shown in FIG. 4, a plurality of lamps 10, each having respective Triac devices 64–74, pulse transformers 76, pulse circuits 78 and an A-D convertor 84 connected thereto, may be plugged into local power supply outlets at desired locations, by means of the terminals 60, 62 thereof. A dimming capability may then be made available by merely running signal wire to each of the respective A-D convertors 84, wherein the control leads 80, and 82 may be connected in parallel, respectively, for control by a single 0 – 10 volt D.C. power supply. It will be appreciated that such installation constitutes a distinct advantage over prior art dimming systems, wherein each lamp requires power wiring permanently installed and routed to the dimmer bank, as discussed hereinabove.

As mentioned above, an embodiment of the invention may encompass a plurality of quartz lamps, each having a single light output rating, wherein the successive lamps are selected so that their light outputs satisfy the same doubling relationship described above with respect to the filaments 12–22. Accordingly, this embodiment utilizing single filament lamps may correspond identically to the circuitry illustrated in FIG. 4 wherein the elements 12–22 may then preferably constitute the filaments of separate quartz lamps. In such an installation, only the switching control wires need be coupled to the dimmer bank, whereas the power wiring for the lamps may be connected to local power supply outlets as described above.

Figure 5:
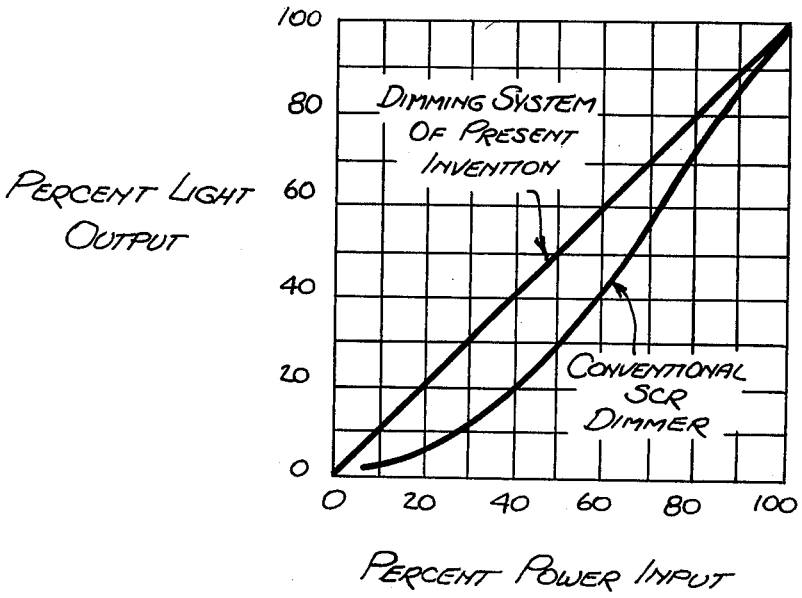
FIG. 5 graphically represents the increased lighting efficiency obtainable when using the present invention as compared to a conventional thyristor dimming circuit.
Figure 4:
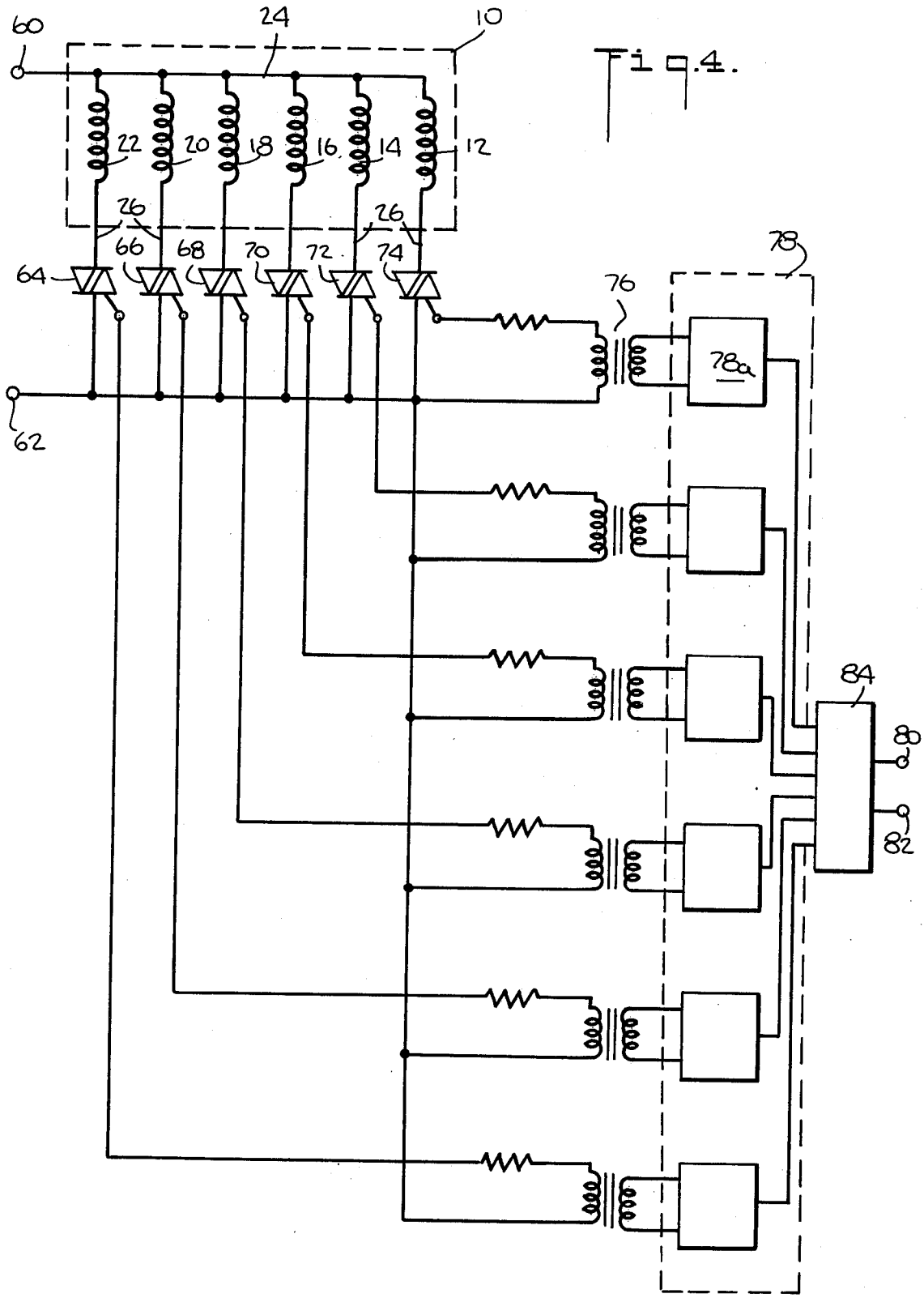

FIG. 5 illustrates the greater efficiency realized by the present invention as compared to a conventional SCR dimming system. For example, the dimming system of the present invention provides a one-to-one ratio of percent power input to percent light output. In the conventional SCR dimming system, however, the comparable ratio is only about 0.6 in the center of the dimming range. This improved efficiency of the present invention is due to the fact that the lamp filaments are always operated at their designed voltage rather than at reduced voltages where the ratio of heat (infrared) to visible light is greater.

In summary, the present invention provides a lighting system wherein the light intensity is adjustable without a shift in color, and wherein the efficiency of the system is constant at all light levels. Also, the installation costs for the lighting system disclosed herein are relatively low in relation to comparable costs of conventional systems, and this lower installation cost results from the fact that there is no necessity to run power wire to the remotely located control panel, since the adjustable light intensity of the lighting system can be controlled by means of signal wire. The installation procedures are simplified since the individual lamps of the lighting system disclosed herein may be plugged into standard A.C. outlets. Furthermore, since the current levels are relatively low at the time the lamp filaments are supplied with power in the present invention, the lighting system does not produce radio frequency interference signals, and does not require large and expensive chokes to overcome high current level switching signals. As discussed above, the color temperature of the light provided by the present invention remains constant as the light intensity is varied. None of the earlier lighting systems provide this function which is advantageous for lighting TV studies, and for applications wherein color filters are used in conjunction with a dimming system.

Although particular embodiments of the invention are herein disclosed for purposes of explanation, various modifications thereof, after study of this specification, will be apparent to those skilled in the art to which the invention pertains.

What is claimed is:

1. An incandescent lamp for providing a variable light output in response to a single voltage input, comprising a plurality of at least four filaments, wherein a first one of said filaments has a predetermined light output rating for the single voltage, and each successive filament has a corresponding light output rating which is double that of the preceding filament, said plurality of filaments each having contacts arranged so that any one of said filaments may be energized singly and any combination of said filaments may be energized simultaneously by application of the single voltage, wherein the lamp brightness may be varied in increments substantially less than the total brightness obtainable from said lamp.

2. An incandescent lamp as set forth in claim 1, wherein one contact of each of said plurality of filaments is connected to a common electrode, and wherein the light output from said lamp has a constant color characteristic independent its intensity.

3. An incandescent lamp as set forth in claim 2, having a filament energizing control circuit connected thereto and comprising switching means operative to connect said filaments to a power source in a selected order wherein the brightness of the lamp may be varied in increments corresponding to the brightness of the lowest rated filament.

4. An incandescent lamp as set forth in claim 3, wherein said switching means comprises:

a plurality of electronic switching devices, wherein each of said filaments has at least one said device coupled thereto;

driving means for selectively activating each of said electronic switching devices into a fully conductive state to supply current to the filament coupled thereto; and control means connected with said driving means and operative to energize driving means in response to a variable control signal, to thereby control said variation in lamp brightness.

5. An incandescent lamp as set forth in claim 4, in which said control means comprises an analog-to-digital convertor, having a plurality of outputs corresponding in number to the number of filaments in said lamp, wherein said outputs are energized in a digital pattern in response to a varying input signal applied to said convertor; and in which said electronic switching devices have control electrodes and said driving means comprises a plurality of pulsing circuits coupled respectively between said convertor outputs and control electrodes of said electronic switching devices.

6. A variable-brightness lighting system comprising:

lighting means including a plurality of at least four differently rated filaments having power ratings at a predetermined voltage such that each successively higher powered filament provides substantially twice the light intensity of the preceding filament; and switching means selectively connected to successively energize such filaments according to a binary relationship with respect to said successive power ratings of said filaments, wherein said filaments are energizable so that the brightness of the lighting system is variable in increments corresponding to the brightness of the lowest powered filament.

7. A variable-brightness lighting system as set forth in claim 6, wherein said switching means comprises a multiposition switch connected between said filaments and a source of power, said switch having a plurality of electrical contacting elements arranged to be connected with said filaments in a predetermined order which defines a consecutive binary number pattern, wherein a first group of said contacting elements corresponds to the least significant binary bit and is arranged to connect with the lowest powered filament, and a plurality of additional groups of said contacting elements correspond respectively to each significant binary bit of higher order, and are arranged respectively to connect with each higher powered filament.

8. A variable-brightness lighting system as set forth in claim 6, wherein said lighting means comprises a plurality of quartz lamps and said differently rated flaments are disposed respectively within said quartz lamps.

9. A variable-brightness system as set forth in claim 6, wherein said switching means comprises:

a plurality of electronic switching devices, wherein each of said filaments has at least one of said devices coupled thereto;

driving means for selectively activating each of said electronic switching devices into a fully conductive state to supply current to the filament coupled thereto; and control means connected with said driving means and operative to energize said driving means in response to a variable control signal, to thereby control said variation in brightness.

10. A variable-brightness lighting system as set forth in claim 9, wherein said lighting means comprises a plurality of quartz lamps and said differently rated filaments are disposed respectively within said quartz lamps.

11. A method of varying the brightness of a lighting system of a type having a plurality of at least four differently rated filaments, wherein each successively higher powered filament provides substantially twice the light intensity of the preceding filament, comprising the steps of selectively energizing said filaments in a binary number pattern, and controlling said binary number pattern so that the lowest powered filament is energized by the least significant bit and the highest powered filament is energized by the most significant bit, whereby said lamp brightness is varied in increments corresponding to the light from the lowest powered filament.

12. A lighting system for providing illumination of variable brightness, comprising a plurality of at least four differently rated filaments, wherein each successively higher powered filament provides substantially twice the light intensity of the preceding filament, means for selectively energizing said filaments in a binary numbered pattern, and means for controlling said binary numbered pattern so that the lowest powered filament is energized by the least significant bit and the highest powered filament is energized by the most significant bit, wherein said lamp brightness is varied in increments corresponding to the light intensity of the lowest powered filament.

* * * * *